US010569184B2

(12) United States Patent
Middleton

(10) Patent No.: US 10,569,184 B2
(45) Date of Patent: Feb. 25, 2020

(54) SELF-PROPELLED TOY GLIDER

(71) Applicant: Connor Lee Middleton, Germantown, TN (US)

(72) Inventor: Connor Lee Middleton, Germantown, TN (US)

( * ) Notice: Subject to any disclaimer, the term of this patent is extended or adjusted under 35 U.S.C. 154(b) by 0 days.

(21) Appl. No.: 16/165,918

(22) Filed: Oct. 19, 2018

(65) Prior Publication Data

US 2019/0134522 A1 May 9, 2019

Related U.S. Application Data

(63) Continuation of application No. 15/667,371, filed on Aug. 2, 2017, now abandoned.

(60) Provisional application No. 62/399,118, filed on Sep. 23, 2016.

(51) Int. Cl.

| | |
|---|---|
| ***A63H 27/00*** | (2006.01) |
| ***A63H 27/14*** | (2006.01) |
| ***A63H 29/00*** | (2006.01) |
| ***A63H 29/18*** | (2006.01) |
| ***A63H 27/08*** | (2020.01) |

(52) U.S. Cl.

CPC ..... *A63H 27/14* (2013.01); *A63H 27/00* (2013.01); *A63H 27/02* (2013.01); *A63H 27/08* (2013.01); *A63H 29/00* (2013.01); *A63H 29/18* (2013.01)

(58) Field of Classification Search

CPC ..... A63H 27/00; A63H 27/14; F41B 7/02

See application file for complete search history.

(56) References Cited

U.S. PATENT DOCUMENTS

| | | | | |
|---|---|---|---|---|
| 5,240,448 A * | 8/1993 | Ishikawa | A63H 27/14 | 446/230 |
| 5,496,202 A * | 3/1996 | Pons | A63H 27/00 | 446/64 |
| 5,901,926 A * | 5/1999 | Zheng | A63H 27/08 | 244/153 R |
| 6,048,246 A * | 4/2000 | Forti | A63H 27/007 | 446/62 |
| 6,349,902 B1 * | 2/2002 | Cripe | A63H 27/08 | 244/153 R |
| 6,565,404 B2 * | 5/2003 | Oblack | A01K 15/025 | 446/46 |
| 7,731,557 B2 * | 6/2010 | Nelson | A63H 27/001 | 446/36 |

* cited by examiner

*Primary Examiner* — John A Ricci
(74) *Attorney, Agent, or Firm* — Ulmer & Berne LLP

(57) ABSTRACT

A self-propelled toy glider includes a flexible frame and a flight surface. The flexible frame may be deformed and held within the user's hand. When deformed, the flexible frame stores spring energy. This spring energy is subsequently used to propel the self-propelled toy glider forward as it returns to original shape.

5 Claims, 7 Drawing Sheets

SELF-PROPELLED TOY GLIDER

REFERENCE TO RELATED APPLICATION

The present application is a continuation of U.S. non-provisional application Ser. No. 15/667,371, entitled SELF-PROPELLED TOY GLIDER, filed Aug. 2, 2017, which claims the benefit of U.S. provisional application Ser. No. 62/399,118, entitled SELF-PROPELLED TOY GLIDER, filed Sep. 23, 2016, the disclosure of each of which is hereby incorporated by reference in its entirety.

FIELD

Embodiments relate, generally, to a toy glider. More specifically, a toy glider with a flight surface and an elastically deformable frame, wherein the elastically deformable frame provides a mechanism for a self-propelled launch.

BACKGROUND

Toy and recreational gliders are popular among children and adults, ranging from simple paper airplanes to more sophisticated remote-control models. These gliders provide an entertaining and educational opportunity to explore aviation, aerodynamics, and physics.

SUMMARY

Embodiments can be directed to a toy glider with a flight surface supported by a frame. At least a portion the frame can elastically deform to provide spring energy for self-propelling the toy glider during a launch.

BRIEF DESCRIPTION OF THE DRAWINGS

The particular features and advantages of the various embodiments, as well as, other objectives will become apparent from the following description taken in connection with the accompanying drawings in which.

DETAILED DESCRIPTION

Figure 1:
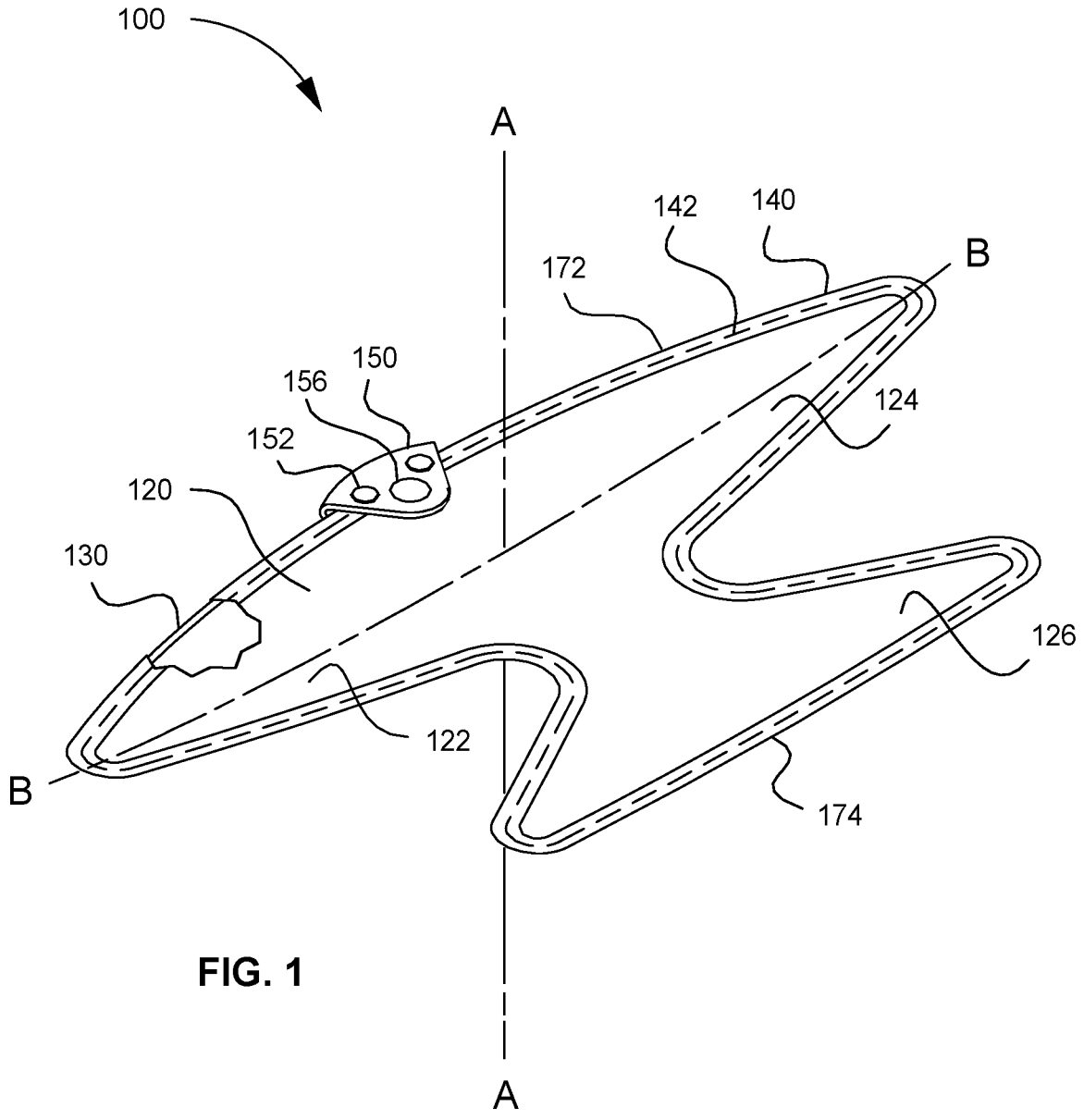
FIG. 1 shows a top perspective view of a first embodiment of a glider with a flight surface and flexible frame.

FIG. 1 shows a first embodiment, glider 100, to include flight surface 120, flexible frame 130, nose element 150, fasteners 152, and finger hold 156. An exemplary construction pertaining to a glider can involve sewing a fabric surface to a flexible frame using a peripheral hem. Accordingly, FIG. 1 shows flight surface 120 and flexible frame 130 attached by hem 140 and stitching 142. By way of example, hem 140 may be folded fabric. Alternatively, a hem may be integral with flight surface 120 and folded around flexible frame 130. FIG. 1 also shows axis A-A perpendicular to flight surface 120. To provide aerial stability, flight surface 120 may be cambered or arcuate, as shown by line B-B. Flight surface 120 can be comprised of left wing surface 122, right wing surface 124, and tail surface 126. Nose element 150 may provide forward weight to lead glider 100 through the air. As described in greater detail in subsequent sections, glider 100 can assume an elastically deformed shape for a self-propelled launch.

Flight surface 120 may be constructed of any number of thin flexible materials, to include polymer fabric, polymer sheet, or natural fiber fabric. Examples of a polymer fabric include nylon or rip-stop nylon. An example of a polymer sheet is Tyvek®, made from high-density polyethylene fibers. An example of a natural fiber fabric is cotton. Flight surface 120 is of sufficient surface area and shape for gliding flight of glider 100. Hem 140 and stitching 142 are shown as a mechanism to attach at least a portion of flight surface 120 to flexible frame 130. The flight surface 130 may also be secured to flexible frame 130 using a variety of attachment mechanisms, to include glue, thermal welding, and fasteners. In its entirety, or in designated regions, flight surface 120 may be porous to allow air to pass thru during flight. This may be advantageous applied to achieve certain aerodynamic stability and glide angle characteristics, and may reduce glider weight. Flight surface 120 may be advantageously designed to billow during flight, that is, a flight surface may or may not be attached to frame in a taut manner. Glider 100 may be further defined by a forward portion 172 and an aft portion 174.

At least a portion of flexible frame 130 is designed for elastic deformation. Flexible frame 130 may be constructed from metal, plastics, composite materials, and combinations thereof. An example of a preferred material is spring-steel. Another example material for flexible frame construction is fiberglass. To achieve desirable strength, stiffness, and aerodynamic characteristics, frame may have a varying cross-section. As examples, cross-section of flexible frame 130 may be circular (as shown), but it may also be non-circular to achieve desired directional stiffness and strength properties. As an example, a rectangular cross-section may have a height greater than the width. This particular rectangular configuration may be easier to compress to establish spring forces, yet have greater strength and stiffness to support vertical loads during flight. Alternatively, the frame may have an aerodynamic shape to reduce drag or otherwise create aerodynamic lift during flight.

A frame may partially or completely define the outer shape of the glider or flight surface. As an example, flexible frame 130 of glider 100 (FIG. 1) is aligned with the outer shape of wing portion 172 and the outer shape of tail portion 174, completely defining the outer shape of the glider. Alternatively, a flexible frame may only form a portion of the glider. As an example, an elastically deformable frame may simply form a fuselage or a portion of a fuselage.

Figure 2:
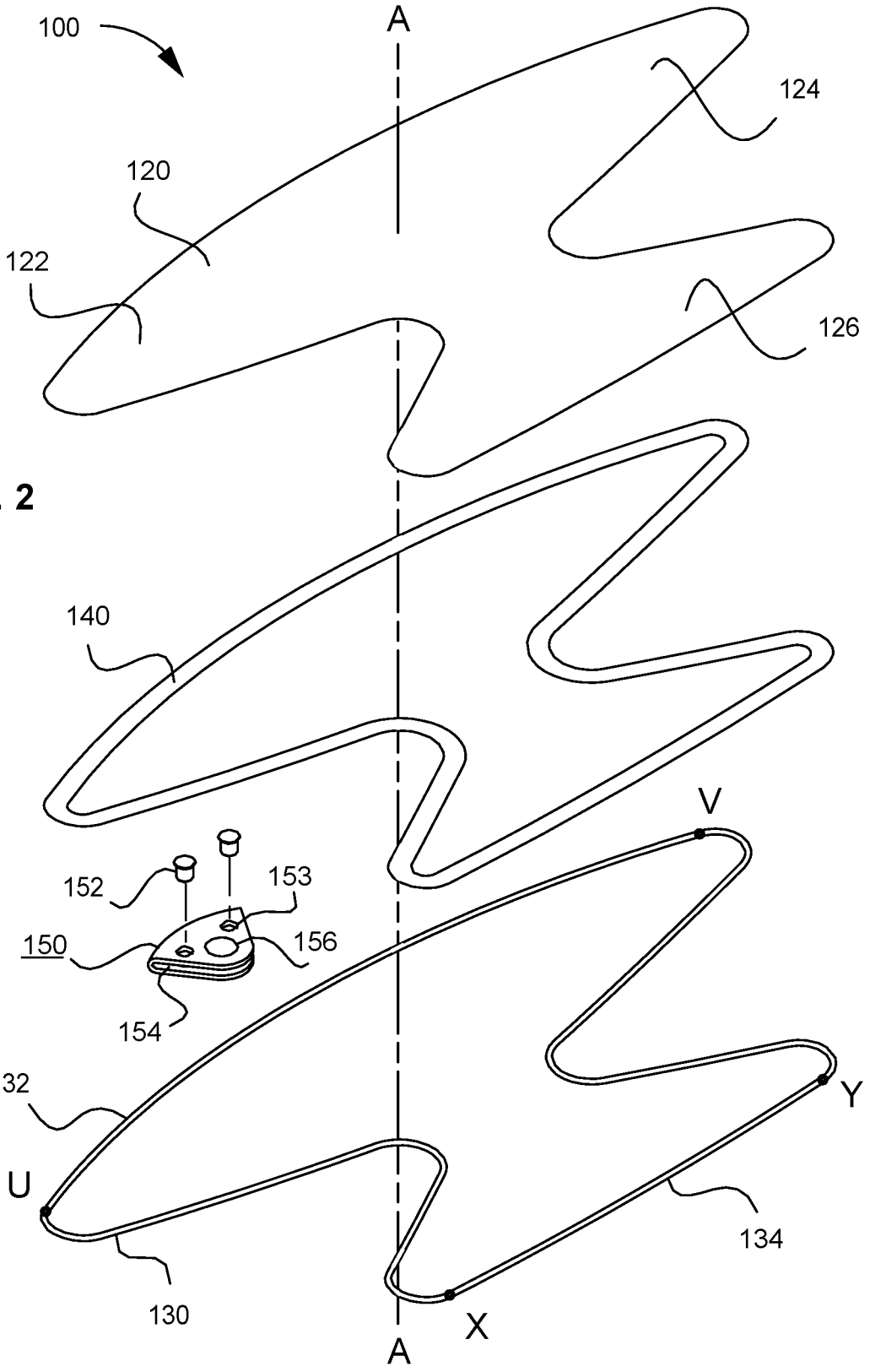
FIG. 2 shows an exploded top perspective view of the glider of FIG. 1 to include a flight surface, nose element, and flexible frame.

FIG. 2 is an exploded view of glider 100, to include flight surface 120, flexible frame 130, nose element 150, and hem 140. Nose element 150 is configured with slot 154 to enable fixation to flexible frame 130. Nose element 150 is fastened to flexible frame 130 using fasteners 152 in combination with fastener holes 153. Fasteners 152 and corresponding fastener holes 153 may at least be partially threaded or may incorporate a non-threaded fastening mechanism, such as, a rivet connection. Nose element 150 may also be fastened by adhesives to frame 130 or flight surface 120. Exemplary materials for fastener 152 include metals, plastics, or composites, and combinations thereof. Nose element 150 has finger hold 156 in the form of a dimple shape to facilitate holding glider 100 in a deformed shape, as described in subsequent section. Finger hold 156 may take the form of a dimple (shown), protrusion, or hole. Nose element 150 may be at least partially comprised of plastic, metal, or foam, the latter a common glider material for absorbing impact. Nose element 150 may be slidably connected to frame 130 for selective lateral positioning, where the nose element 150 can provide a weight-based mechanism for trimming glider 100 to follow a straight flight path or an arcuate flight path.

A flexible frame can include a beam element or a series of interconnecting beam elements arranged to achieve a desired shape and spring stiffness. Substantially long and relatively thin beams are inherently flexible, so a preferred glider frame or frame section may be described as a beam or beam element, wherein the length of beam or beam element is substantially greater than any dimensional width, height, or diameter associated with the beam's cross-section. With continuing reference to FIG. 2, flexible frame 130 may defined as a series of interconnecting arcuate or straight beam elements collectively achieving a desired shape and spring stiffness. Concurrently, flexible frame 130 has an overall shape to peripherally support flight surface 120. More specifically, flexible frame 130 may be further defined as having forward frame portion 132 and aft frame portion 134. Forward frame portion 132 may be defined as a segment of flexible frame 130 extending from point U to point V and may further be described as an arcuate beam element. Aft frame portion 132 may be defined as a segment of flexible frame 130 extending from point X to point Y. Forward frame portion 132 may be defined as a segment of flexible frame 130 forming an arcuate, elongated beam element or segment.

Figure 3A:
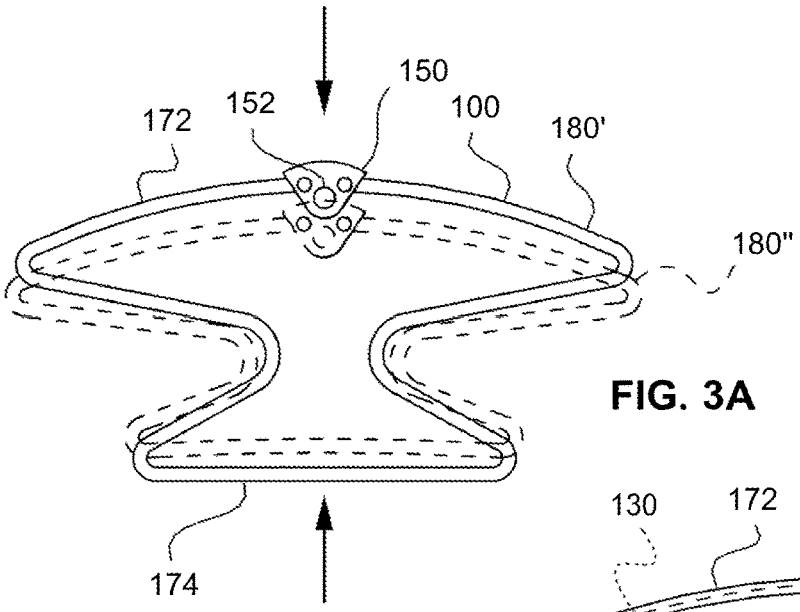
FIG. 3A shows a top view of the glider shown in FIG. 1 with a shape change when subjected to compressive forces.
Figure 3B:
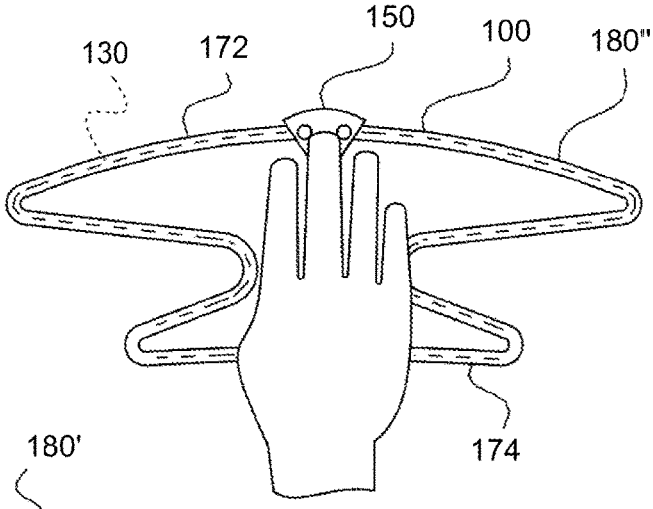
FIG. 3B shows the glider of FIG. 1 in a compressed shape, held within a hand of the user.
Figure 3C:
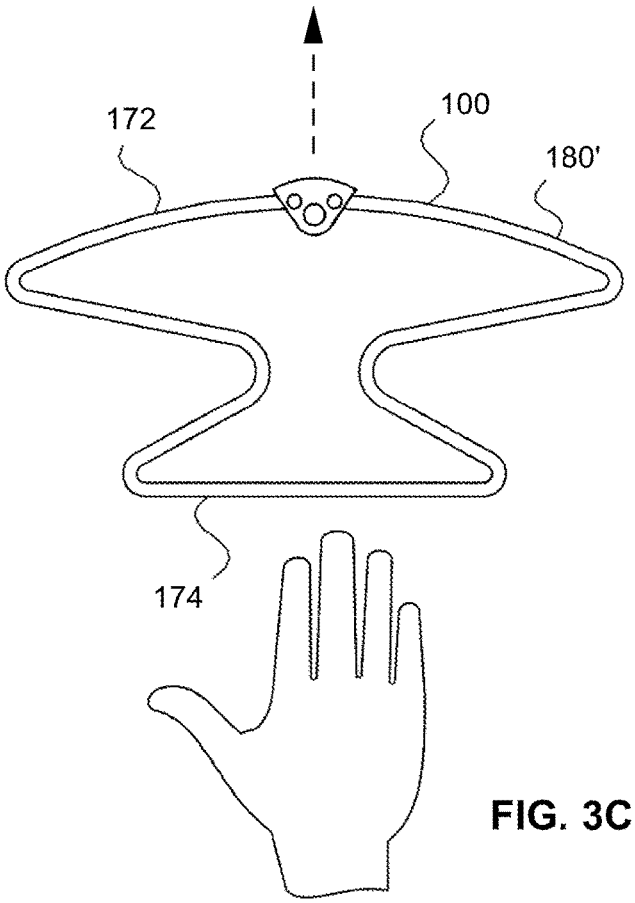
FIG. 3C shows the glider of FIG. 1 released and in flight.

Glider 100 exhibits a beneficial degree of flexibility that enables spring-energy to be stored prior to flight as a result of a shape change of flexible frame 130. Accordingly, FIGS. 3A, 3B, and 3C demonstrate a preferred method for advantageously launching glider 100. The arrows shown in FIG. 3A represent opposing forces applied to glider 100, demonstrating the ability of glider 100 to change shape. More specifically, glider 100 is shown in a first shape 180' (at rest) and second shape 180" (compressed). At least a portion of flexible frame 130 is able to store spring forces associated with elastic deformation. This elastic deformation can be associated with beam bending and may be accompanied by beam torsion. Elastic deformation of the flexible frame 130 may be associated with a degree of twisting of the elastic frame. By way of example, wing surface 122 and right wing surface may twist about their longitudinal axis. Referring now to FIG. 3B, a user is able to compress glider 100 toward a second shape 180". Finger hold 156 (FIG. 3A) may be used to assist the user compress and hold glider 100 in second shape 180". More specifically, a force may be applied to forward portion 172 and an opposing force is applied to aft portion 174. With continued reference to FIG. 3B, glider 100 assumes second shape 180" with elastic potential energy stored in flexible frame 130. Accordingly, flexible frame 130 is deformed to store elastic spring force, readily available to provide a launching force. As shown in FIG. 3C, the user releases glider 100 into flight as aft portion 174 of glider 100 pushes against the user's hand. During this self-propelled launch, glider 100 transitions back to first shape 180' (natural shape at rest or in flight). A user's hand is shown in an exemplary mode of operation, however, any number of means and objects can be used to compress glider 100 and provide a suitably platform for a self-propelled launch.

The glider can be essentially programmed with the appropriate thrust to provide a good flight. In part, this programming of flight thrust is a combination of frame geometry, material properties, and the extent of deformation. Unlike many other hand-launched gliders, the embodiments disclosed herein may require less finesse to achieve a desirable flight. This is especially appealing to younger children that might otherwise struggle with the traditional hand-launch of a toy glider, but may otherwise be fully capable of holding and releasing an object. In addition, combining arm and hand movements can initiate longer flights or produced curved trajectories.

Durability of toy gliders remains problematic. Free flight gliders often strike stationary objects and may become damaged or cause damage to the object they strike, especially when the glider is used indoors. The flexible frame and compliant flight surface of certain embodiments may provide a lightweight and durable glider because impact forces can be absorbed by the frame upon impact with an object. More specifically, impact forces are diminished, as at least a portion of kinetic energy is stored upon impact as elastic potential energy through elastic deformation of the flexible frame, ultimately released again as kinetic energy as the glider rebounds away from an object. As an example, frame 130 of glider 100 of FIG. 1 can store spring energy upon impact and rebound against objects it strikes. Accordingly, the inventive aspects of the present glider provide an improved glider with advantageous durability associated with a high degree of safety for users and objects the glider may strike.

Figure 4A:
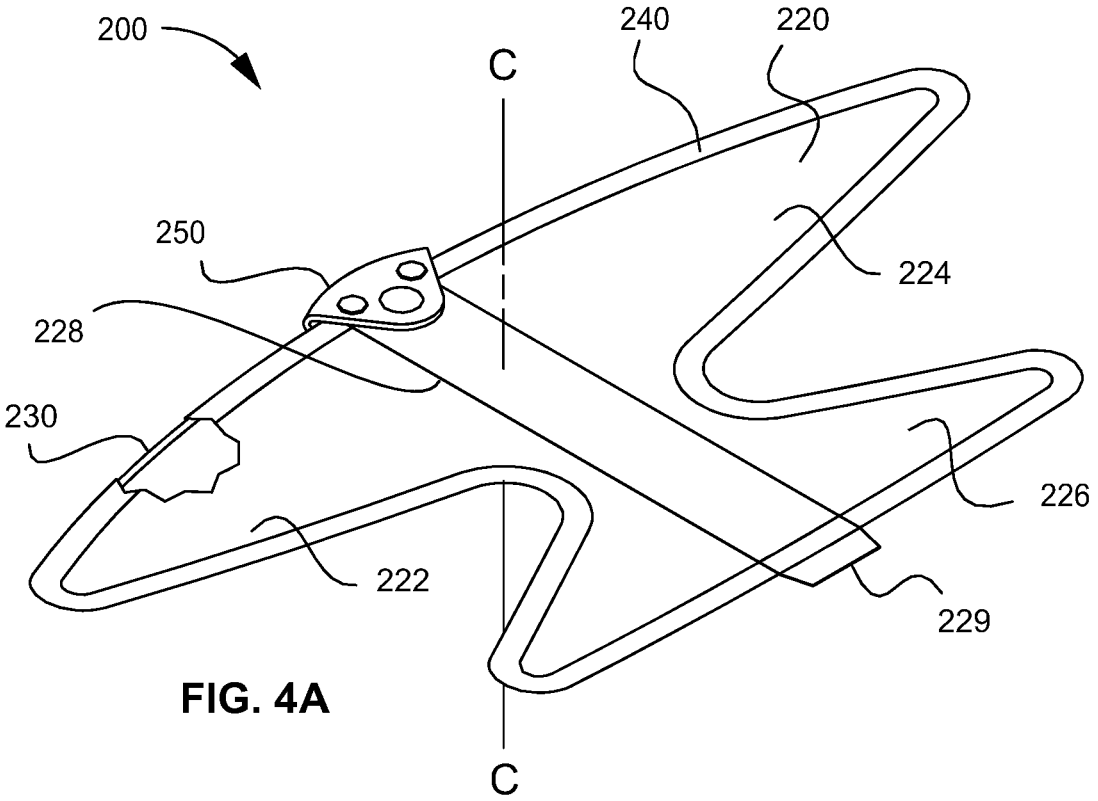
FIG. 4A shows a top perspective view of second embodiment of a glider having a flexible frame, flight surface, nose element, and a longitudinal element.
Figure 4B:
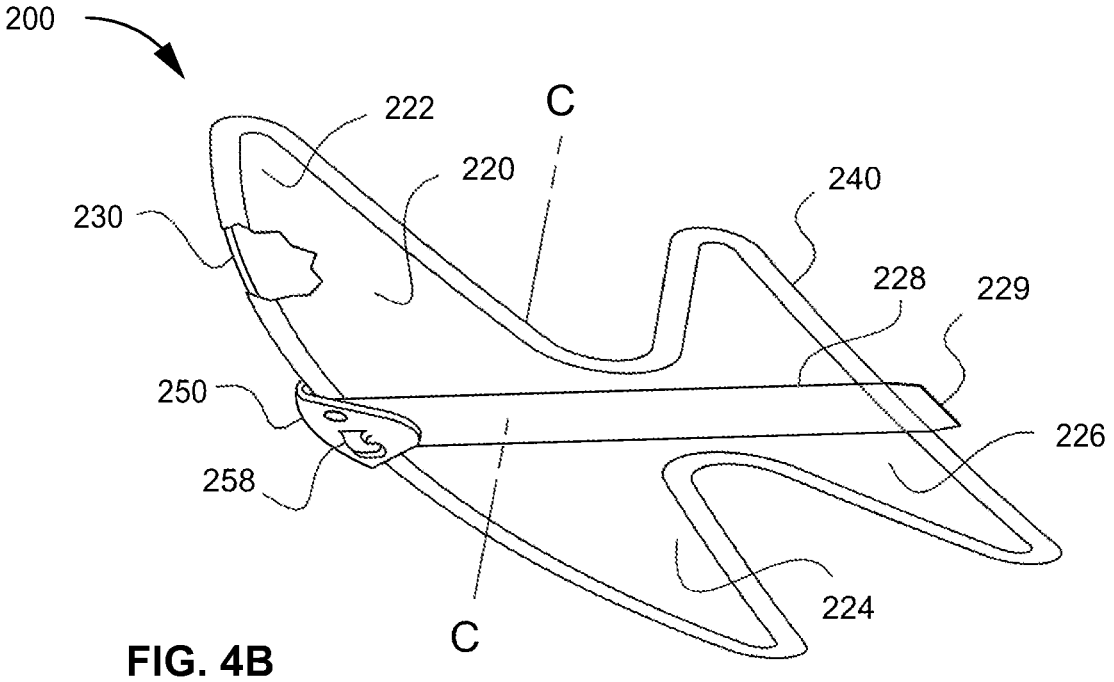
FIG. 4B shows a bottom perspective view of the glider shown in FIG. 4A to include an attachment element associated with the nose.

A second embodiment, glider 200, is shown in FIGS. 4A and 4B. Similar to glider 100, glider 200 has flight surface 220, frame 230, and nose element 250. Line C-C defines an axis substantially vertical during level flight. Flight surface 220 is attached to frame 230 by hem 240. Hem 240 is sewn or otherwise bonded to secure flight surface 220 to frame 230. Flight surface 220 can be comprised of left wing surface 222, right wing surface 224, and tail surface 226. At least a portion of frame 230 may be purposefully and temporarily deformed to store spring forces for launching glider 200. Glider 200 is also comprised of central strap 228 and pull tab 229. FIG. 4B shows a bottom-perspective view of glider 200, and particularly shows attachment element 258 for attaching other components, such as, a tether or rubber-band launcher. Alternatively, attachment element 258 can be used as a finger hold for a traditional hand-launch, wherein glider 200 may be tossed in the manner of launching a paper airplane.

Figure 5:
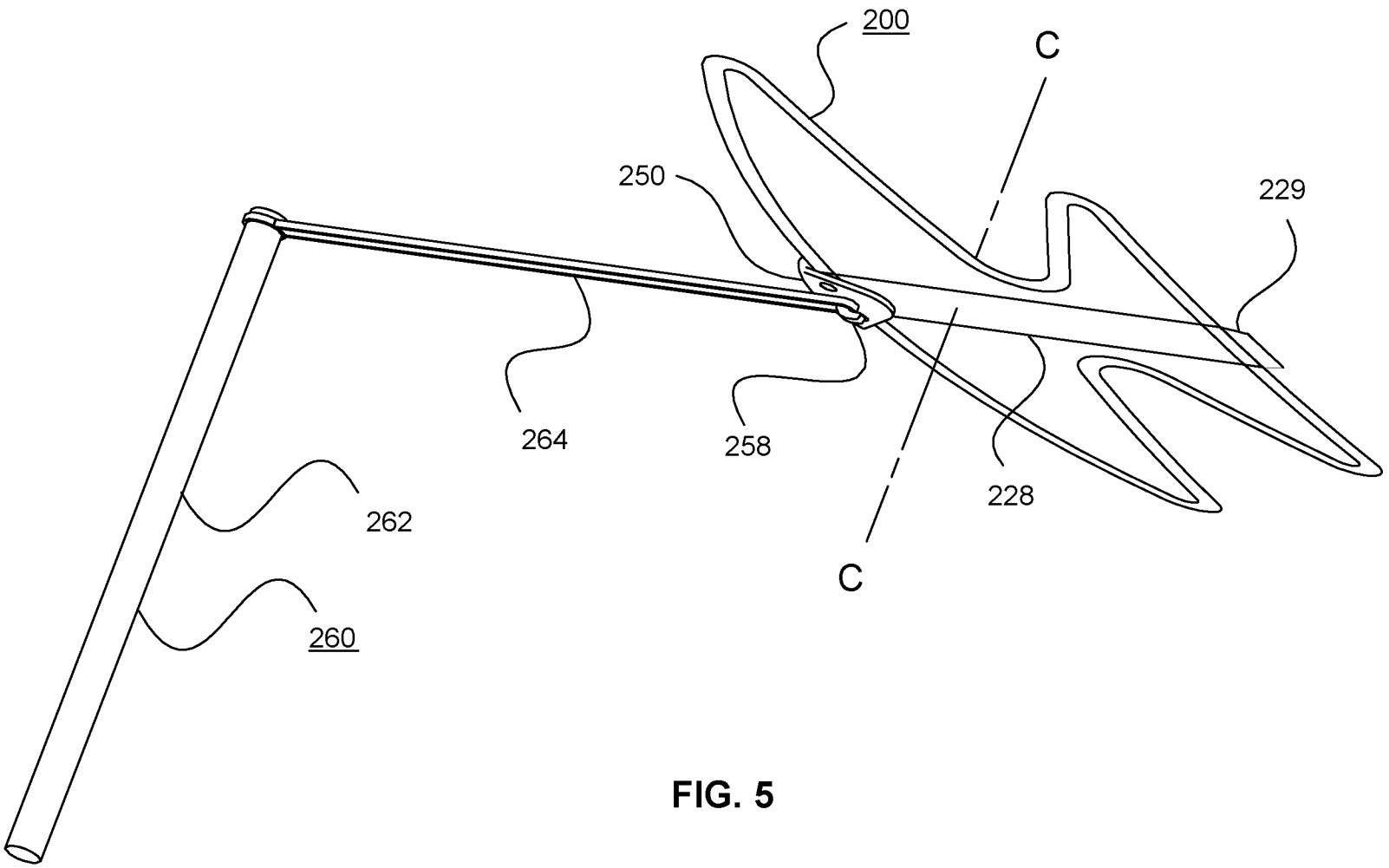
FIG. 5 shows a bottom perspective view of the glider shown in FIG. 4A associated with a rubber-band catapult launcher.

Like glider 100, glider 200 can be launched in a similar manner by deforming frame 230, especially in compression, followed by a self-propelled launch by hand as elastic potential energy is converted to kinetic energy (see FIGS. 3A thru 3C). For longer flights, especially outdoors, glider 200 can also be launched by using a rubber band-based launcher. Referring now to FIG. 5, glider 200 is shown coupled with a rubber band launcher 260. The rubber band launcher 260 includes handle 262 and rubber band 264. Related to a method of launching glider 200, one hand holds handle 260 and the other hand is used to grab pull tab 229 and load rubber band 264 in tension for launch (user's hands are not shown). Accordingly, FIG. 5 shows glider 200 ready for launch, as rubber band 264 is loaded in tension. The user launches glider 200 by releasing pull tab 229. Central strap 228, may be configured as a substantially non-elastic member, serving as a tension band, to prevent glider 200 from being overstretched. As an example, central strap 228 may be a woven nylon strip. Conversely, central strap 228 may be configured with a degree of elasticity to provide spring forces for launch when tensioned.

Alternatively, an attachment element, such as attachment element 258 of glider 200, can be used to attach a tether. As an example, a tether can be a slender, flexible ribbon constructed of a synthetic or natural fabric. One end of the tether may be permanently attached to the glider or it may have a release mechanism. By holding the free end of the tether, the user is able to propel glider 200 in a circular motion and optionally release the tether to propel glider 200 into free flight.

Figure 6A:
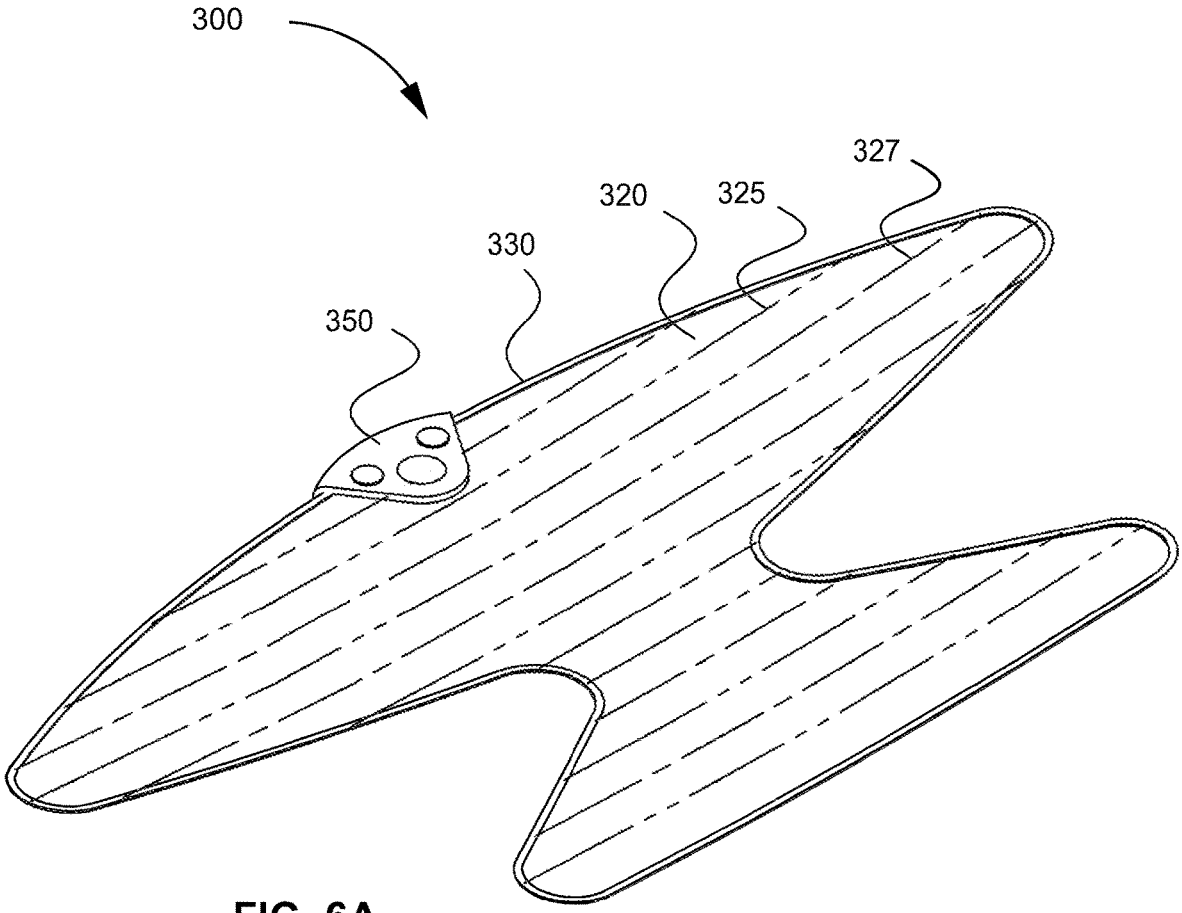
FIG. 6A shows a top perspective view of a third embodiment of a glider having a flexible frame, flight surface, and nose element.
Figure 6B:
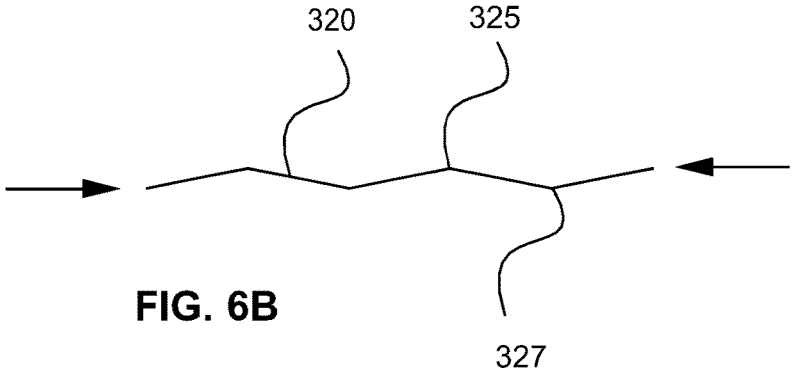
FIG. 6B shows a portion of the flight surface folding in a prescribed manner when subjected to compressive forces.

A third embodiment, glider 300, is shown in FIG. 6A, to include flight surface 320, frame 330, and nose element 350. Flight surface 320 has patterned creases, allowing it to fold in a manner similar to a foldable fan. More specifically, flight surface 320 is formed in part by creases 325 and creases 327. Flight surface 320 may be formed from a plastic sheet with a capacity for elastic deformation. Viewed as a partial lateral cross-section, FIG. 6B shows a portion of flight surface 320 in at partially compressed state. Compression forces are indicated by the arrows. More specifically, the crease pattern is formed by alternating a first crease 325 and second crease 327, predisposed to fold flight surface 320 in compression. Flight surface 320, as an example, can be a plastic sheet, capable of deforming in a fan-like or accordion-like manner when pre-creased and subjected to compression. Further, at least a portion of the aforementioned deformation of flight surface 320 can be elastic deformation, wherein spring forces are stored for launch. At least a portion of frame 330 can store spring energy by elastic deformation, similar to aforementioned gliders described herein. Like glider 100, glider 300, can be launched by introducing a shape change (see FIGS. 3A, 3B, and 3C).

Figure 7:
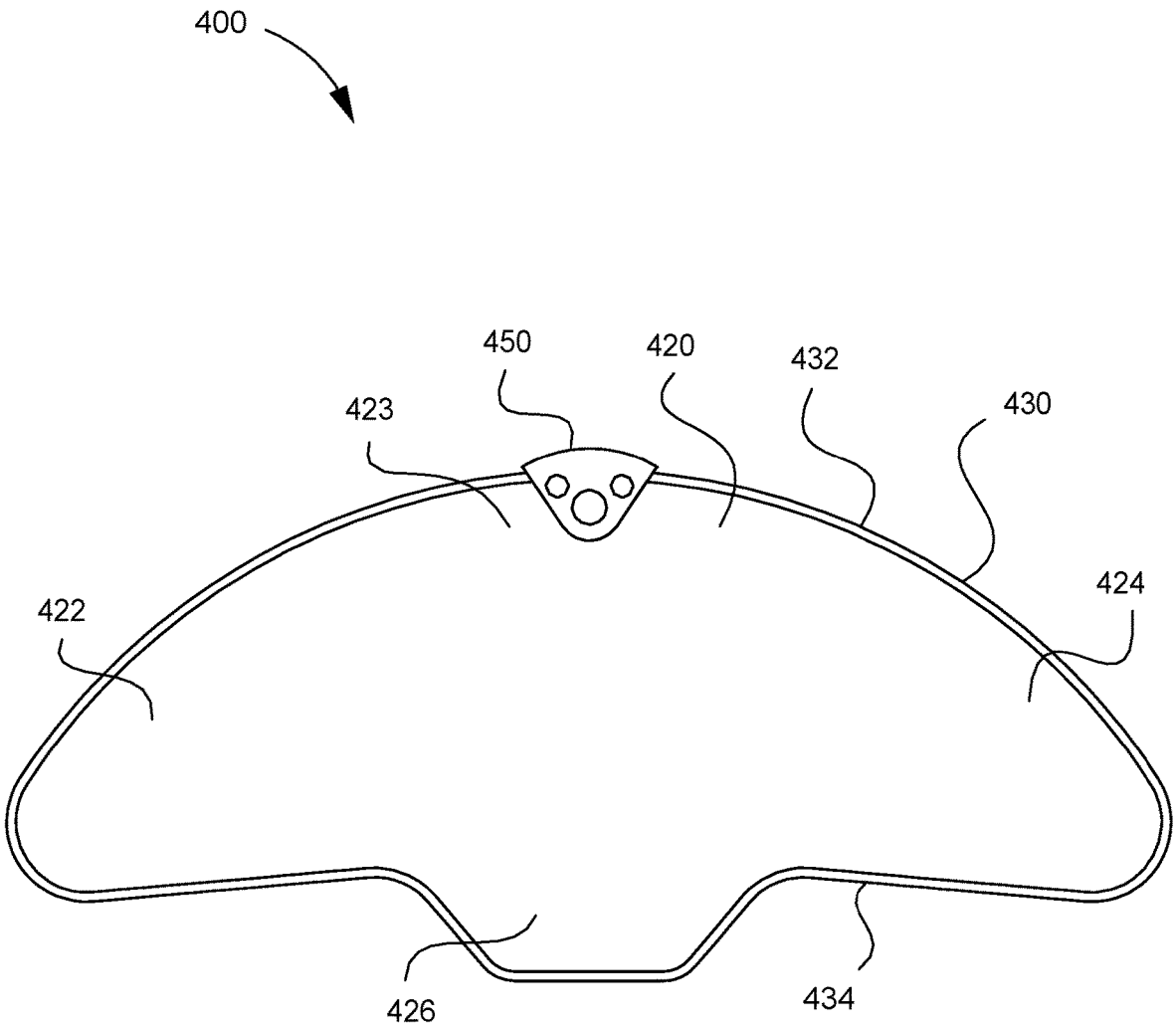
FIG. 7 shows a top view of a fourth embodiment of a glider to include an elastic frame and a flight surface.

A fourth embodiment is shown in FIG. 7, glider 400, comprised of frame 430 and flight surface 420. Flight surface 420 can be comprised of left wing surface 422, right wing surface 424, and tail surface 426. At least a portion of frame 430 is capable of storing spring forces when frame 430 experiences a shape change. Stored spring forces may be stored for self-propelled launch and may be created by deforming frame in a variety of shapes, to include elongation or compression longitudinally. Flight surface 420 may be at least partially attached to frame 430 using a variety of methods, to include, adhesives, welding, thermal melting, or hem and stitch, as examples. Glider 400 is shaped as a flying wing and frame 430 can further be defined by forward frame region 432 and rear frame region 434. Forward frame region 432 may have a degree of elastic flexibility to absorb impact. Rear frame region 434, defined as the trailing edge of wing, may be considered an elongated beam element, having a different degree of elastic flexibility to store spring-forces for a self-propelled launch.

Certain embodiments described serve as examples and should not limit the scope and spirit of the present invention. Our experience has shown a degree of twisting or other distortion in 3D space may accompany compressive loading of the frame longitudinally. The construction of a peripheral frame defining the outer boundary of the glider may create a glider that can be folded and collapsed thru twisting of the frame, creating a smaller package for travel. In addition, any number of components known in the art can be added to enhance flight, to include a vertical stabilizer, flaps, and landing gear. Many elements may be adjustable to trim the glider or establish certain flight trajectories. In addition, portions, or the entirety of the flexible frame may be bent to trim the aircraft for optimal flight or to otherwise change the flight trajectory.

The invention claimed is:

1. A method of launching a self-propelled toy glider comprising the steps of:

a. providing a glider, the glider having a flight surface peripherally attached to an elastically deformable frame element, the glider further comprising a first shape, wherein the first shape is a natural shape and a second shape, wherein the second shape is an elastically deformed shape having stored spring energy used to propel the glider forward during launch b. deforming the glider from the first shape to the second elastically deformed shape;

c. holding the glider in the elastically deformed shape with a force applied to a forward portion of the glider and an opposing force applied to an aft portion of the glider; and d. releasing the force applied to the forward portion of the glider to release the stored spring energy, propelling the glider into flight during a transition from the second shape back to the first shape.

2. The method of claim 1, wherein the flight surface is a thin flexible material, and wherein the thin flexible material is taut when the elastically deformable frame is in the first shape and flexibly deformed when the flight surface is in the second shape.

3. The method of claim 1, wherein the flight surface is coupled to the elastically deformable frame by a method selected from the group consisting of sewing, gluing, thermal welding, and combinations thereof.

4. The method of claim 1, wherein the elastically deformable frame comprises a plurality of interconnecting beam elements collectively defining an elastically deformable shape.

5. The method of claim 1, wherein the flexible frame peripherally supports the outer shape of the flight surface.

* * * * *